US007971629B2

(12) United States Patent
Bekurts et al.

(10) Patent No.: US 7,971,629 B2
(45) Date of Patent: Jul. 5, 2011

(54) STRAND GUIDE ROLLER

(75) Inventors: Axel Bekurts, Mülheim (DE); Albrecht Girgensohn, Düsseldorf (DE); Axel Stavenow, Düsseldorf (DE); Erich Hovestaedt, Rehde (DE); Dirk Mangler, Willich (DE)

(73) Assignee: Hermmerich & Colleagues, Duesseldorf (DE)

( * ) Notice: Subject to any disclaimer, the term of this patent is extended or adjusted under 35 U.S.C. 154(b) by 173 days.

(21) Appl. No.: 12/226,455

(22) PCT Filed: Mar. 30, 2007

(86) PCT No.: PCT/EP2007/002859

§ 371 (c)(1),
(2), (4) Date: Oct. 17, 2008

(87) PCT Pub. No.: WO2007/121821

PCT Pub. Date: Nov. 1, 2007

(65) Prior Publication Data

US 2009/0165985 A1 Jul. 2, 2009

(30) Foreign Application Priority Data

Apr. 21, 2006 (DE) ..... 10 2006 019 147
Aug. 25, 2006 (DE) ..... 10 2006 040 011

(51) Int. Cl.
*B22D 11/124* (2006.01)
*B22D 11/128* (2006.01)

(52) U.S. Cl. ..... 164/442; 164/448

(58) Field of Classification Search ..... 164/442, 164/448
See application file for complete search history.

(56) References Cited

U.S. PATENT DOCUMENTS

| | | | | |
|---|---|---|---|---|
| 3,965,974 | A | 6/1976 | Sernetz et al. | |
| 4,010,528 | A | 3/1977 | Boehmer | |
| 4,485,836 | A * | 12/1984 | Streubel et al. | 164/442 |
| 6,484,793 | B1 * | 11/2002 | Scheurecker | 164/448 |
| 7,325,586 | B2 | 2/2008 | Deibl et al. | |
| 7,617,862 | B2 | 11/2009 | Guttenbrunner et al. | |

FOREIGN PATENT DOCUMENTS

| | | |
|---|---|---|
| DE | 7501394 | 10/1975 |
| RU | 2 216 615 C1 | 11/2003 |

OTHER PUBLICATIONS

Alexander Krainev, Machine Mechanics, 2000, pp. 548,860 Machinostroyenie, Moscow, Russia.

* cited by examiner

*Primary Examiner* — Kevin P Kerns
(74) *Attorney, Agent, or Firm* — Abelman, Frayne & Schwab

(57) ABSTRACT

A strand guide roller (100) of a strand guide device for guiding a cast strand (200) includes at least one first and one second sectional rollers arranged next to each other, includes a middle bearing (120-1, 120-2) located between both sectional rollers (110-1, 110-2) for receiving and supporting the roller journal (112-1) of the first sectional roller (110-1) formed on an end surface of the first sectional roller (110-1) adjacent to the second sectional roller (110-2), with the first and second sectional rollers being connected with each other outside of the middle bearing by a plug-in connection.

5 Claims, 2 Drawing Sheets

STRAND GUIDE ROLLER

BACKGROUND OF THE INVENTION

1. Field of the Invention

The invention relates to strand guide rollers of a strand guide device for guiding a cast strand e.g., a slab after it leaves a strand casting mold.

2. Description of the Prior Art

Publications WO 2004/094087 and WO 2005/016578 describe the state of the art with respect to strand guide devices with strand guide rollers. In all of the strand guide rollers, which are disclosed in these publications, all of the separate components, such as roller bodies or rotation-preventing elements in form, e.g., of plain keys, should be stringed on a common central shaft; therefore, the assembly and an eventual disassembly of such strand guide roller are very expensive and require use of special tools. In addition, it is very difficult to realize an inner cooling of the rollers.

State-of-the art with regard to strand guide rollers which are divided once or multiple times, is disclosed in U.S. Pat. No. 5,279,535. Such strand guide roller includes several sectional rollers arranged axially next to each other, with each sectional roller having two roller journals at its both ends, respectively. The two roller journals, of two arranged next to each other sectional rollers, which extend in opposite directions, are received in their respective axial bearings that typically are combined in a split middle bearing.

Optionally, though this is not shown in U.S. Pat. No. 5,279,535, such a middle bearing can have, between the oppositely extending roller journals, additionally, a curved-tooth gear coupling for transmission of a torque between both adjacent sectional rollers.

Such split middle bearings in form of two separate, arranged next to each other, bearings with an optional curved-tooth gear coupling therebetween, are disadvantageously rather wide and, therefore, form a particular wide bearing window in which a to-be-guided and to-be-supported strand is not supported by the sectional rollers. Moreover, such middle bearings, because they are formed of a plurality of separate parts, are rather expensive.

Proceeding from this state-of-the art, the object of the invention is to provide a strand guide roller that can be at least simply split and provide an improved strand guidance.

SUMMARY OF THE INVENTION

The object is achieved by providing a strand guide roller characterized in that between the second sectional roller and the roller journal of the first sectional roller, a plug-in connection is formed for plug-in connecting the first and second sectional rollers with each other, and in that the middle bearing is formed as an unsplit single bearing.

The middle bearing serves for supporting the first sectional roller, receiving its roller journal. To this end, the middle bearing should be formed as an unsplit single bearing. By the plug-in connection, the second sectional roller is so connected with the first sectional roller that the second sectional roller can be supported on the first sectional roller. Because of the plug-in connection with the first sectional roller, the second sectional roller does not need any separate bearing, rather the second sectional roller is supported by the plug-in connection means in or on the first sectional roller. Therefore, with the inventive strand guide roller, a conventional, in the state-of-the art, second bearing in the middle bearing for the second sectional roller as well as the curved-tooth gear coupling can be dispensed with. Because the middle bearing can have only one separate bearing, the width of the middle bearing and, therefore, the window width between both adjacent sectional rollers can be reduced in comparison with the state-of-the-art. The advantage of this consists in that the bearing surface for the slab is increased, whereby the guiding and support function of the strand guide roller for the slab is improved.

It is advantageous when the middle bearing is formed as a separate bearing in form of a standard bearing, which makes it more cost-effective than a split bearing. In addition, with the inventive strand guide roller, the sectional rollers are easily mounted and dismounted.

According to one embodiment, the plug-in connection can be so formed that a roller journal of one sectional roller is inserted in a recess of an adjacent sectional roller. Then, the plug-in connection means is not formed as an additional component, e.g., as a separate coupling, the advantage consists in that the costs of such component are eliminated.

The formation of the cross-section of the roller journal and the cross-section of the associated recess in form of polygons provides an advantage in that both adjacent sectional rollers are connected with each other form-and forcelockingly for transmission of a torque. The transmission of a torque between sectional rollers is important, in particular with sectional rollers non-driven by a motor. In this case, the form-and forcelocking plug-in connection provides an advantage that consists in that when one sectional roller starts to rotate upon a contact with a transported slab, the adjacent sectional rollers rotate therewith even when they do not have any contact with the slab. The advantage of this consists in that the excessive heating and, thereby, warping and wedging of the sectional rollers is prevented.

The recess is subjected to very high loads, in particular when it is formed as a polygon for transmission of a torque and, therefore, can quickly wear out, with the corners and flanks being rounded during the operation, so that the transmission of a torque is not sufficient or is not at all possible. Therefore, it is advantageous when the recess is not formed directly in the end surface of a sectional roller but instead is defined and limited by an annular insert member insertable in a bore in the end surface of a sectional roller. The advantage of the insert member consists in that it, as a wear-out part, can be economically replaced. An alternative renewing of the recess directly in the end surface of the sectional roller is, in comparison, noticeably more expensive.

The provision of the cooling channel in the sectional rollers has the advantage in that they would not overheat; the amount of a possible cooling can be influenced by the number of channels. When the cooling channel has an inner tube the outer diameter of which is smaller than the inner diameter of the cooling channel, the inner tube forms a first cooling conduit, and the intermediate space between the inner tube and the cooling channel forms the second cooling conduit. In the first and second cooling channels, the cooling medium can flow in opposite directions. The invention relates to both driven and non-driven strand guide rollers.

Further advantageous embodiments of the strand guide roller form the subject matter of dependent claims.

BRIEF DESCRIPTION OF THE DRAWINGS

The description is accompanied by five Figures, wherein.

DETAILED DESCRIPTION OF THE PREFERRED EMBODIMENTS

Figure 1:
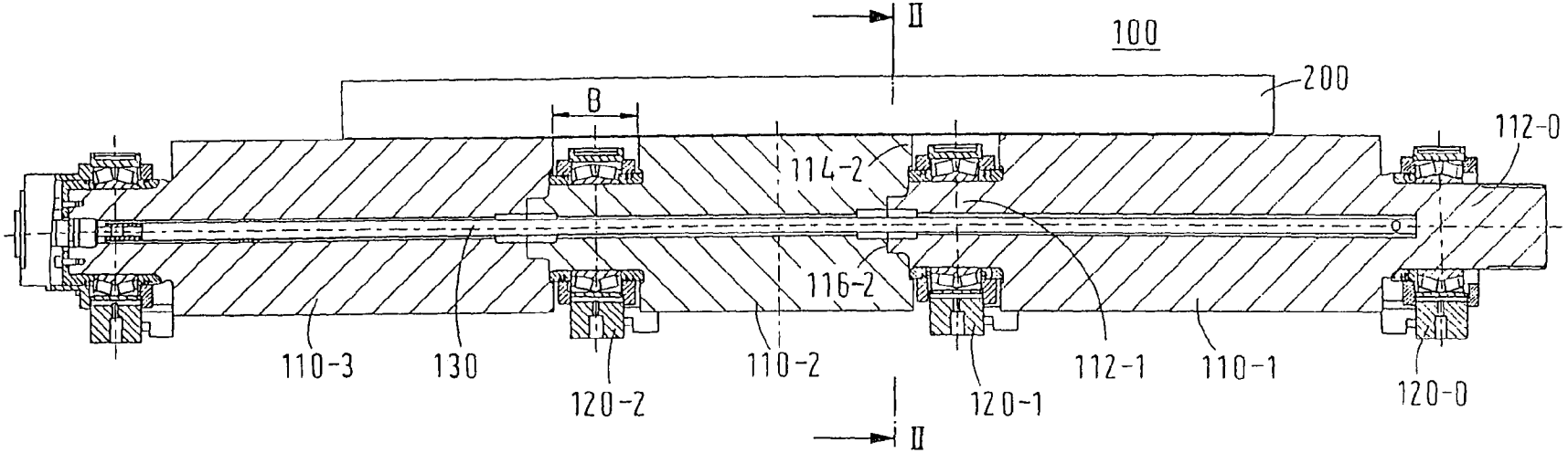
FIG. 1 is a first embodiment of the inventive strand guide roller.

The invention will be described in detail below with reference to embodiments shown in the above-mentioned drawings. In the drawings, the same components are designated with the same reference numerals.

FIG. 1 shows a first embodiment of the inventive strand guide roller 100. The strand guide roller, e.g., is twice divided and includes correspondingly three sectional rollers 110-1, 110-2, 110-3 altogether. The second division is represented by two middle bearings 120-1, 120-2 which are arranged in the transition regions between respective two sectional rollers. The middle bearings insure an axial alignment of the sectional rollers. The first sectional roller 110-1 is supported by a first middle bearing 120-1 and an outer bearing 120-0, with the both bearings receiving, respectively, roller journals 112-1, 112-0 of the first sectional roller 110-1.

The second sectional roller 110-2 is not directly supported by the middle bearing 120-1. Instead, it has, at its end side 114-2 adjacent to the first sectional roller 110-1, a recess 116-2 for receiving the roller journal 112-1 or its projection pivoted relative to the roller journal proper.

Figure 2:
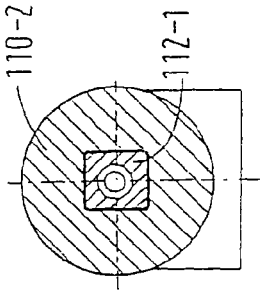
FIG. 2 is a cross-section of the strand guide roller according to the first embodiment.

FIG. 2 shows that the recess 116-2 is formed or shaped in accordance with the cross-section of the roller journal 112-1 or of its projection. In an assembled condition, as shown in FIG. 1, the first and second sectional roller 110-1, 110-2 are so connected that the roller journal 112-1 is precisely inserted in the correspondingly formed recess 116-2. The roller journal 112-1 and the recess 116-2 form in this way a plug-in connection for both sectional rollers. A second bearing for receiving and supporting the second sectional roller 110-2 is, therefore, unnecessary in the inventive embodiment of the strand guide roller. Therefore, the middle bearings 120-1, 120-2 can be formed as unsplit single bearings, the advantage of which consists in that they have a noticeably smaller window width B.

Naturally, alternatively to the embodiment shown in FIG. 1, other embodiments of the plug-in connection are conceivable. It is alternatively conceivable that the second sectional roller 110-2 has, on its end side 114-2 adjacent to the first sectional roller 110-1, no recess but rather also a roller journal having a diameter smaller than the diameter of the roller journal 112-1 of the first sectional roller 110-1. The plug-in connection can be realized in this case so that the roller journal of the second sectional roller is inserted in a recess in the end surface of the roller journal 112-1 of the first sectional roller. It is also conceivable, naturally, to form the plug-in connection in form of separate components provided between the two sectional rollers 110-1, 110-2 outside of the middle bearing 120-1.

The plug-in connection can be formed, with the inventive strand guide roller, as a coupling for transmission of a torque or be simply formed as a pivot bearing which does not provide for transmission of any torque. For the reasons mentioned above in the general portion of the description, a formation as a coupling makes sense also with the strand guide roller 110 which is not externally driven by a drive 150 (see FIG. 3). With the above-described embodiment in which a roller journal in inserted in a recess, a coupling function can be easily realized by forming the recess not as a circular one but rather, e.g., in form of a polygon. An example of this is shown in FIG. 2.

Figure 3:
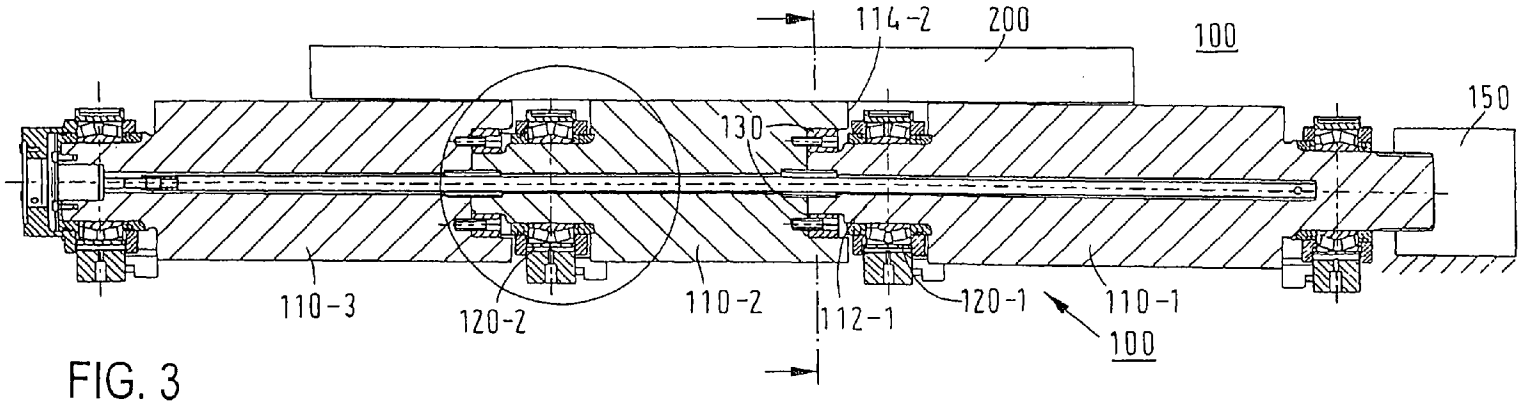
FIG. 3 is a second embodiment of the inventive strand guide roller.
Figure 5:
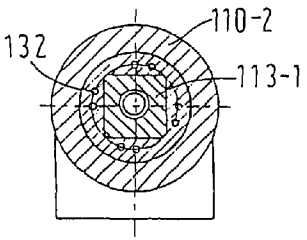
FIG. 5 a cross-section of a detail of the strand guide roller according to the second embodiment.
Figure 4:
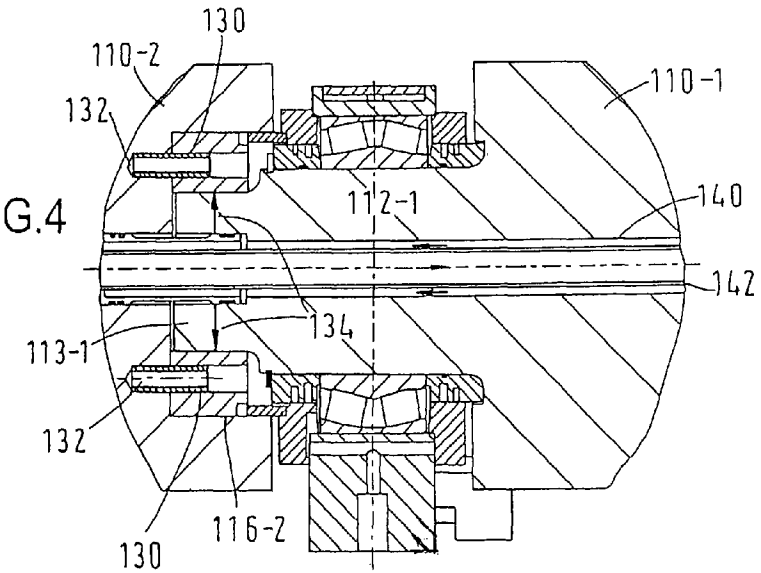
FIG. 4 is a cross-section of the strand guide roller according to the second embodiment.

FIG. 3 shows a second embodiment of the inventive strand guide roller that differs from the first embodiment by the design of the plug-in connection. FIG. 4 shows this embodiment of the plug-in connection at an increased scale, therefore, it would be described in detail below with reference to FIG. 4. In the plug-in connection shown in FIG. 4, the recess 116-2 in the second sectional roller 110-2 and the roller journal 112-1 of the first sectional roller 110-1 are not exactly adapted to each other, rather the cross-section of the roller journal 112-1 or of its projection is substantially smaller than the cross-section of the recess 116-2. In addition, the recess 116-2 advantageously is not limited, for simplicity reasons, to a polygonal cross-section, even when the plug-in connection is formed as a coupling, but rather is formed as a simple bore. Into this bore, a preferably annular insert member 130 is inserted and which is secured there against rotation with locking pins 132. The insert member 130 itself has a recess 134 that is precisely adapted to the cross-sectional of the roller journal 112-1 or its projection 113-1 when the recess 134 is formed circular, no torque is transmitted between the two sectional rollers 110-1, 110-2, when it is formed, however, as a polygon, in particular, e.g., as a square, as shown in FIG. 5, then with a corresponding cross-section of the roller journal 112-1 or 113-1, a torque is transmitted. The annular insert member 130 is subjected to very large loads in the region of the recess 134 during transmission of the torque, and that is why it wears out very strongly in the transition region between the projection 113-1 and the recess. Fortunately, the annular insert member as a wear-out part can be simply and economically replaced.

In FIGS. 1-5, a central axial cooling channel in the strand guide roller 100 is shown, which also extends through the sectional rollers. FIG. 4 shows that an inner tube 142, the outer diameter of which is smaller than the inner diameter of the cooling channel 140, can be inserted in the cooling channel 140. This provides a possibility to transport cooling medium in the inner tube 142 in one direction and to transport the cooling medium in the space between the inner tube and the wall of the cooling channel 140, e.g., in the opposite direction. When a large cooling capacity is necessary, several cooling channel parallel to the axis in form, e.g., of a revolver barrel can be formed in separate sectional rollers. These cooling channels can be, as desired, sealed or not sealed against each other in separate sectional rollers.

The invention claimed is:

1. A strand guide roller (100) of a strand guide device for guiding a cast strand (200), comprising:

at least one first sectional roller (110-1) and at least one second sectional roller (110-2) arranged next to each other, the first sectional roller (110-1) having a roller journal (112-1) on an end surface thereof adjacent to the second sectional roller (110-2);

at least one middle bearing (120-1, 120-2) in form of an unsplit single bearing located between the first and second sectional rollers (110-1, 110-2) for receiving and supporting the roller journal (112-1) of the first sectional roller; and a plug-in connection formed between the second sectional roller (110-2) and the roller journal (112-1) of the first sectional roller (110-1), for connecting the first and the second sectional roller with each other, the plug-in connection including a bore formed in a surface (114-2) of the second sectional roller (110-2) adjacent to the first sectional roller (110-1), an insert member (130) received in the bore and having in its center thereof a recess (116-2) for receiving the roller journal (112-1) of the first sectional roller (110-1), and a locking pin (132) for securing the insert member (130) in the bore against rotation;

wherein a cross-section of the roller journal (112-1) and a cross-section of the receiving recess (116-2) are formed as a polygon.

2. A strand guide roller (100) according to claim 1, wherein a cooling channel (140) extending coaxially with a common axis of the first and second sectional rollers (110-1, 110-2) or parallel to the common axis extends through both first and second sectional rollers (110-1, 110-2) for conducting a cooling medium.

3. A strand guide roller (100) according to claim 2, wherein an inner tube (142), an outer diameter of which is smaller than an inner diameter of the cooling channel (140), extends in the cooling channel (140).

4. A strand guide roller (100) according to claim 1, wherein the first and second sectional rollers (110-1, 110-2) have, respectively, a separate cooling and are sealed against each other in a region of the at least one middle bearing.

5. A strand guide roller (100) according to claim 1, comprising a drive (150) for driving the strand guide roller (100).

* * * * *